US005095580A

United States Patent [19]

Capponi

[11] Patent Number: 5,095,580

[45] Date of Patent: Mar. 17, 1992

[54] COSMETIC APPLICATOR

[75] Inventor: Joseph P. Capponi, Maspeth, N.Y.

[73] Assignee: Aversa & Martin, Inc., Brooklyn, N.Y.

[21] Appl. No.: 560,354

[22] Filed: Jul. 31, 1990

[51] Int. Cl.[5] ..... A46B 15/00

[52] U.S. Cl. ..... 15/184; 132/317; 132/320; 401/112

[58] Field of Search ..... 15/184, 433; 132/218, 132/311, 317, 318, 313, 320; 401/109, 115, 117, 62, 82, 112, 113

[56] References Cited

U.S. PATENT DOCUMENTS

| | | | |
|---|---|---|---|
| 1,983,083 | 12/1934 | Irelan | 15/184 |
| 2,043,250 | 6/1936 | Kasdan et al. | 132/318 |
| 2,207,296 | 7/1940 | Lee | 15/433 |
| 2,582,451 | 1/1952 | Mureau | 15/184 |
| 2,591,537 | 4/1952 | Gordon | 15/184 |
| 2,607,942 | 8/1952 | Gordon | 15/184 |
| 2,631,321 | 3/1953 | Mureau | 15/184 |
| 2,657,411 | 11/1953 | Becker | 15/184 |
| 2,789,304 | 4/1957 | Leavin | 15/184 |
| 2,913,750 | 11/1959 | Aversa | 15/184 |
| 3,268,939 | 8/1966 | Aversa | 15/184 |
| 3,863,288 | 2/1975 | Aversa | 15/184 |

FOREIGN PATENT DOCUMENTS

| | | | |
|---|---|---|---|
| 1087110 | 8/1960 | Fed. Rep. of Germany | 15/184 |
| 1231133 | 12/1966 | Fed. Rep. of Germany | 401/112 |
| 36815 | 11/1965 | German Democratic Rep. | 401/112 |

*Primary Examiner*—Harvey C. Hornsby
*Assistant Examiner*—Mark Spisich
*Attorney, Agent, or Firm*—Morrison Law Firm

[57] ABSTRACT

A cosmetic applicator such as a lipbrush is provided with an actuator which includes a tab part locating in and extending outwardly of a slot formed in an applicator barrel. By the sliding of the tab between opposite extreme ends of the slot, a lipbrush element is retracted or extended from within the barrel. The actuator is a single-piece, spring steel shaped member which includes the tab as a first part, a second elongate part joined to the tab extending in the barrel close to the barrel inner surface, this second part joining a third part extending transversely in the barrel to joinder with a fourth part that extends close to the inner barrel surface and runs back in the direction from when the second part originated but not to the same length as the second part so that a terminal part to which the fourth part is joined is disposed transversely of that fourth part but terminates spaced from the second part so a terminus of the terminal part can serve as a pivot point for flexing the second part inwardly during initial actuator insertion in the barrel but thereafter and because the said terminus is spaced such relative to the second part, the second part cannot be flexed by normal use forces enough to cause the tab joined therewith to hangup inside the barrel and render the applicator unserviceable.

6 Claims, 1 Drawing Sheet

COSMETIC APPLICATOR

BACKGROUND OF THE INVENTION

The present invention relates to cosmetic applicators and refers more particularly to an actuator member for embodiment in such applicators for retracting and extending an applicator element such as a lipbrush between stored and use positions.

Various constructions of cosmetic applicators are known which provide a specific form of applicator element such as a lipbrush which in non-use mode is disposed within a holder, commonly a barrel or tubular housing. When it is desired the lipbrush be used, a suitable means embodied in the applicator is actuated to cause the lipbrush to extend from retracted position within the holder through an opening to an exposed position wherein it conveniently and with facility can be employed for its intended purpose. A cover generally is provided to fit over the holder opening to protect the lipbrush in non-use periods and this cover is in some constructions employed as part of the extension means when the applicator is to be used.

Representative of such constructions are U.S. Pat. Nos. 2,789,304; 2,582,451; 2,591,537; 2,607,942; 2,631,321; 2,657,411; and 2,913,750. Of particular interest is the constructions disclosed in U.S. Pat. Nos. 3,268,939 and 3,868,288 (commonly owned). Both of these last-mentioned patents disclose use of an actuator housed in an applicator barrel and connected with a lipbrush element so that when a tab or radial extension part on the actuator located in an elongated slot formed in the barrel is engaged with an applicator cover slid over an end of the barrel, the actuator tab is caused to slide from one to another of two extremes of the elongated slot thereby extending the lipbrush from a retracted-within-the-barrel positioning of same to its use position, this extension being effected in opposition to the bias effect of a spring engaged with the lipbrush element tending to maintain it in retracted position.

While the actuators of the '939 and '288 patents are effective for the purpose provided, they do have certain disadvantage in that the actuator of the '939 patent is a molded thermosetting resin component formed as a body having an enlarged main part and a narrower cantilevered (from the main part) arm which carries a nose or tab that extends outwardly of the barrel in the elongated slot. Because the arm is relatively long, it can flex inwardly interiorly within the barrel and to an extent found in actual past occurrence, that produces entry of and hangup of the tab inside the barrel so that extension and retraction movement of the lipbrush element no longer is possible.

The actuator of the '288 patent to a large degree provides against this hangup possibility, but this actuator is very expensive to make and assemble, particularly so since it has a complicated shape and requires special assembly operation to fit a barrel elongated slot riding pin in a bore in the actuator body.

The present invention improves the aforesaid types of actuator construction by provision of most simplified and economical form of actuator as can be used with the cosmetic applicators represented by the '939 and '288 patents.

OBJECTS AND SUMMARY OF THE INVENTION

Accordingly, it is an object of the invention to provide a cosmetic applicator and an applicator element actuator therefor which overcomes the drawbacks of the prior art.

It is a further object of the invention to provide an applicator element actuator for use in a cosmetic applicator which is of simplified construction, economical of manufacture, and reliable over long term use of the cosmetic applicator.

It is a still further object of the invention to provide a cosmetic applicator actuator which is formed from a single piece of spring steel that is readily flexed for insertion thereof in the applicator barrel with a predetermined flexure producing force during initial assembly, but yet is designed to resist the lesser flexing forces as may be imposed thereon during normal usage thereby to insure against occurrence of unintended actuator tab recessing within the applicator barrel which if happens would render the applicator useless.

Briefly stated, there is provided a cosmetic applicator such as a lipbrush having an actuator which includes a tab part locating in and extending outwardly of a slot formed in an applicator barrel. By sliding the tab between opposite extreme ends of the slot, a lipbrush element is retracted or extended from within the barrel. The actuator is a single-piece, spring steel shaped-member which includes the tab as a first part, a second elongate part joined to the tab extending in the barrel close to the barrel inner surface, this second part joining a third part extending transversely in the barrel to joinder with a fourth part that extends close to the inner barrel surface and runs back in the direction from whence the second part originated but not to the same length as the second part so that a terminal part to which the fourth part is joined is disposed transversely of that fourth part but terminates slightly spaced from the second part so a terminus of the terminal part can serve as a pivot point for flexing the second part inwardly during initial actuator insertion in the barrel but thereafter and because the said terminus is spaced such relative to the second part, the second part cannot be flexed by normal use forces enough to cause the tab joined therewith to hangup inside the barrel and render the applicator unserviceable.

In accordance with these and other objects of the invention there is provided a cosmetic applicator including a tubular barrel having an open end and an opposite closed end. The barrel has an elongated slot extending along an intermediate length part thereof, and an elongated cosmetic applicator element is slidably received in the barrel, with the applicator element having a retracted position wherein it disposes fully within said barrel but proximal the open end thereof. The applicator element has an extended position wherein it projects a distance outwardly of the barrel open end. Resilient means are engaged with the applicator element and normally hold it in retracted position. An actuator is disposed in the barrel in line with said applicator element and is in abutment therewith. The actuator has a radial tab located in said barrel elongated slot and extends a distance outwardly of an outer surface of the barrel, with the tab being positioned at an extreme of said barrel elongated slot when the applicator element is retracted, the applicator element being slid to extended position when force is applied to the tab to position it at the other extreme of the barrel elongated slot. The actuator comprises a one-piece, generally uniformly thick, resilient member of substantially uniform relatively narrow width but substantially elongated shaped expanse defined by said tab constituting an initial part, a second part orthogonal to said tab and extending longitudinally in the barrel toward the applicator element in close proximity to an inner surface of the barrel and joining a third part extending transversely of the barrel and having abutment with said applicator element, said third part joining a fourth part orthogonal to the third and extending longitudinally away from the applicator element closely spaced with the barrel inner surface, with the fourth part joining a terminal part extending transversely of the barrel and having a terminus spaced a slight distance from the second part, this terminal part being closer spaced axially to the applicator element than where the tab part and said second part have a point of joinder whereby a certain length of the second part adjacent the point of joinder can be with a predetermined force, flexed toward the fourth part and against the terminal part as a pivot to allow an assembly insertion of the actuator member slidably into the barrel but on release of said force, said flexed certain length to restore to close spacing with the barrel inner surface and the tab to extend outwardly of the barrel, the spacing between the terminus of said terminal part and the second part being such that any flexing of said second part certain length induced incident a normal use force applied to said tab when sliding it between its positions at the extremes of said barrel elongated slot, is insufficient to displace said tab into the barrel where it can hangup and prevent any future extending or retracting of the applicator element.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
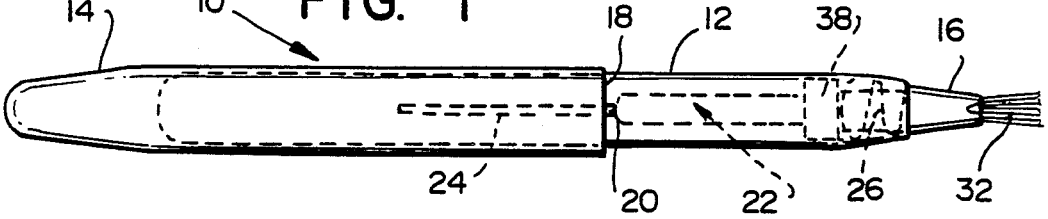
FIG. 1 is a top plan view of a lipbrush cosmetic applicator, with the cover inserted over the closed end of the barrel and in engagement with the actuator tab in such manner as to have extended the lipbrush element outwardly from the barrel to its use position.

Referring to FIG. 1, the cosmetic applicator 10 includes a tubular barrel 12, a cover 14 and an applicator element 16, the element 16 being, by way of example, a lipbrush. The lipbrush 16 is shown in FIG. 1 in extended or use position, i.e., it is extended outwardly axially from the barrel for some distance in a presentation that allows the user to conveniently and with facility employ the lipbrush in a customary cosmetic procedure, e.g., outlining an individual's lip shape with lip cosmetic.

Figure 2:
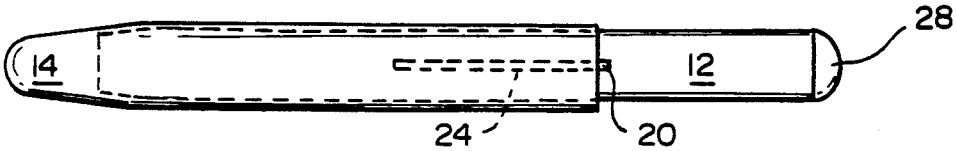
FIG. 2 is a top plan view of the cosmetic application with the cover inserted over the open end of the barrel and positioned such that spring bias has moved the actuator tab to its other extreme elongated slot location corresponding to that in which the lipbrush element is in retracted position.

In the FIG. 2 showing, the applicator 10 has been turned 180 degrees and cover 14 is inserted over the open end of the barrel in which cover disposition, the edge 18 which defines an open end of the cover is snubbed against the tab 20 of the actuator member 22 that will be detailed more fully below, with the tab in turn being at one extreme of elongated slot 24 formed in barrel 12. In the FIG. 2 configuration it is understood that the lipbrush 16 is in retracted position, being held so by compression coil spring 26.

Figure 3:
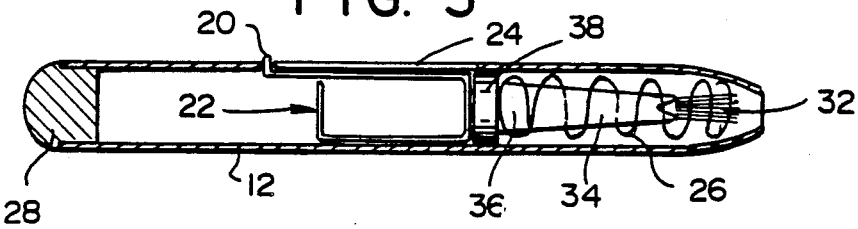
FIG. 3 is a longitudinal sectional view in elevation of the cosmetic applicator barrel and depicts the internal arrangements of the operating components of the applicator, the cover as noted, not being shown.

FIG. 3 in which the cover 14 is not on the applicator 10, depicts with greater detail how in its retracted position, the lipbrush is housed axially in the barrel with the working tip end of the the brush interiorly in the barrel proximal to but recessed slightly from the barrel edge 18.

As noted, one end of barrel 12 has an opening through which the lipbrush moves when extended and retracted, whereas and is seen from FIGS. 2 and 3, the other end of the barrel is sealed, being closed of with a tight-fitting plug element 28. The barrel itself could be made with a thus-shaped integral part, but it is more economically sealed by using plug element 28.

Referring further to FIG. 3, the lipbrush element 16 comprises a tufted bundle 32 of brush hairs held in the clenched grip of and at one end of shankpiece 34, the other end of the shankpiece having a stub-boss 36 secured thereto, this stub boss having a widened flange 38 formed thereon remote from the shankpiece and which flange serves to anchor one end of coil spring 26 abutting with a face of the flange. The other end of the coil spring anchors against the necked-in interior surface of the barrel adjacent barrel edge 18. The tufted bundle 32, shankpiece 34 and the stub-boss(except for the flange 38) are encircled by the spring.

Figure 6:
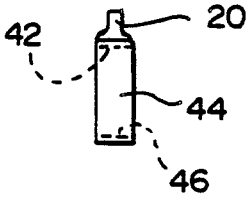

Disposed on the other face side of flange 38 is actuator member 22 which is a shaped, spring steel, one-piece component slidably positioned within the barrel and the instrument which in cooperation with sliding of the cover over the closed end of the barrel, produces the action for effecting extension of the lipbrush from the barrel for use. Its construction is described next with reference being made additionally to FIGS. 4–6.

Actuator member 22 includes an initial or tab part 20, this tab extending radially outwardly a short distance of the barrel as is seen in FIG. 3. Tab part 22 is joined with second part 42, part 42 being orthogonal to the tab and running axially a distance inside the barrel toward flange 38 and closed spaced with the barrel inner surface, the second part in turn joining a third part 44 orthogonal to the second, this third part extending transversely of the barrel as shown and being closely abutted with the other face of flange 38. Fourth part 46 joined to the third part and orthogonal with the latter, runs axially of the barrel away from flange 38 and close spaced to the barrel inner surface, but its run axially is to lesser extent than that of second part 42. Fourth part 46 is joined with terminal part 48 that is orthogonal to this last-mentioned part and the terminal part extends transversely of the barrel to a terminus thereof that is very closely spaced to the under surface of second part 42 so that a certain length 42' of part 42, i.e., the length part extending between the point where tab part 20 joins part 42 and that point on part 42 where the plane of terminal part cuts the second part, constitutes a cantilevered flexure length in the second part, the terminus tip end of the terminal part 48 serving as a pivot point about which the certain length flexing can occur.

Figure 4:
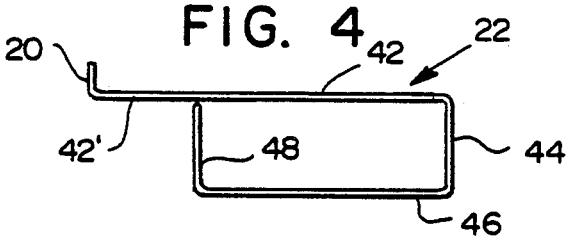
FIGS. 4, 5 and 6 are respective side, top and right end views of the actuator.
Figure 5:
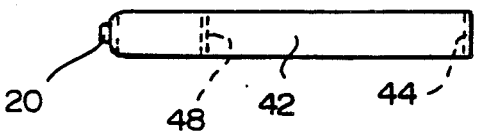

The actuator 22 which is of substantially uniform width and which has its several parts in coplanar relationship, is as seen from the profile showing thereof in FIGS. 3 and 4, a box-like rigidized component that can slide within the barrel without skewing of any one part relative to another and it provides a structure with which positive and sure force can be applied to the flange 38 to overcome the bias force of coil spring 36 and stroke the lipbrush outwardly of the barrel to use position of same.

Figure 7:
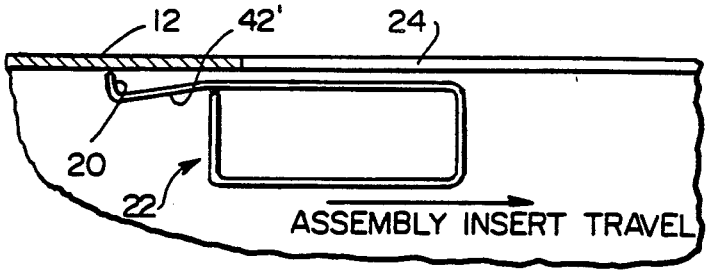
FIG. 7 is a fragmentary side sectional view of a portion of the cosmetic applicator barrel illustrating the flexing character of the actuator.

Actuator 22 is designed to allow initial insertion assembly thereof in the barrel by applying a predetermined flexing force to the certain length 42' thereof so that clearance travel inside the barrel of tab 20 takes place until the tab locates in register with barrel slot 24 at which point, the flexing force can release and the certain length restore from flexed position depicted in FIG. 7 whereupon the certain length disposes parallel to the barrel axis and the tab extends a slight radial distance outwardly of the barrel outer surface where it presents obstruction to the barrel edge 18 so it can be thereby engaged and displaced longitudinally in the barrel elongated slot incident the extension of the lipbrush.

While flexing of the certain length 42' of actuator part 42 is possible under impetus of predetermined flexure force applied thereto, it does not flex in any appreciable manner under and responsive to normal cosmetic applicator use extension of lipbrush activity to an extent that tab 20 can radially inwardly move to recess and hangup position inside the barrel. This is due to the inherent resistance to flexing character of the actuator produced by its particularized shape, but also because the tip end of the terminal part 48 lies up so close to the underside of part 42 that minimized bending of the whole part only can occur and to degree insufficient for tab 20 to inwardly recess in the barrel.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. In a cosmetic applicator including a tubular barrel having an open end and an opposite closed end, said barrel having an elongated slot extending along an intermediate length part thereof, an elongated cosmetic applicator element slidably received in said barrel, said applicator element having a retracted position wherein it disposes fully within said barrel proximal the open end thereof and an extended position wherein it projects a distance outwardly of the barrel open end, resilient means engaged with said applicator element and normally holding said applicator in retracted position, and an actuator disposed in said barrel in line with said applicator element and abutment therewith, said actuator having a radial tab located in said barrel elongated slot and extending a distance outwardly of an outer surface of the barrel, said tab being positioned at an extreme of said barrel elongated slot when said applicator element is retracted, said applicator element being slid to extended position when force is applied to said tab to position it at an opposite extreme of said barrel elongated slot, said actuator comprising a one-piece generally uniformly thick resilient member of substantially uniform relatively narrow width but substantially elongated shaped expanse defined by said tab constituting an initial part, a second part orthogonal to said tab and extending longitudinally in the barrel toward said applicator element in close proximity to an inner surface of the barrel and joining a third part extending transversely of the barrel and having abutment with said applicator element, said third part joining a fourth part orthogonal to the third and extending longitudinally away from the applicator element closely spaced with the barrel inner surface, said fourth part joining a terminal part extending transversely of the barrel and having a tip end lying close to said second part, said terminal part being closer spaced to said applicator element than where said tab part and said second part have a point of joinder whereby a certain length of said second part adjacent said point of joinder can be with a predetermined force flexed toward the fourth part and against the terminal part tip end as a pivot to allow an assembly insertion of said member slidably into said barrel but on release of said force, said flexed certain length to restore to close spacing with the barrel inner surface and said tab to extend outwardly of the barrel, the spacing between the tip end of said terminal part and said second part being such that any flexure of said second part certain length induced incident a normal use force applied to said tab when sliding it between its positions at the extremes of said barrel elongated slot is minimized and therefore insufficient to displace said tab into said barrel.

2. The cosmetic applicator of claim 1 in which the tab, second, third, fourth and terminal parts of said member are arranged coplanar one with each of the others.

3. The cosmetic applicator of claim 2 in which said member is made of metal.

4. The cosmetic applicator of claim 3 in which said member is made of spring steel.

5. The cosmetic applicator of claim 1 in which said applicator element is a lipbrush.

6. The cosmetic applicator of claim 1 further comprising a cover receivable slidably on said barrel in covering position over the open end thereof, said cover in such position engaging said tab when said tab is positioned at the barrel elongated slot extreme wherein said applicator element is retracted, said cover further being slidably receivable on the closed end of said barrel and when so received engaging the tab to slide it to the other extreme of said barrel elongated slot whereby said applicator element is caused to move from retracted position to its extended position.

* * * * *